US006896794B2

(12) United States Patent
Towfighi

(10) Patent No.: US 6,896,794 B2
(45) Date of Patent: May 24, 2005

(54) FUEL FOR INTERNAL COMBUSTION-POWERED TOOLS

(75) Inventor: Kaveh Towfighi, Sigmarszell (DE)

(73) Assignee: Hilti Aktiengesellschaft, Schaan (LI)

( * ) Notice: Subject to any disclaimer, the term of this patent is extended or adjusted under 35 U.S.C. 154(b) by 283 days.

(21) Appl. No.: 10/241,870

(22) Filed: Sep. 10, 2002

(65) Prior Publication Data

US 2003/0051394 A1 Mar. 20, 2003

(30) Foreign Application Priority Data

Sep. 20, 2001 (DE) ..... 101 46 420

(51) Int. Cl.[7] ..... C10L 1/10
(52) U.S. Cl. ..... 208/17; 208/16; 208/15
(58) Field of Search ..... 208/15–17

(56) References Cited

U.S. PATENT DOCUMENTS 3,591,355 A 7/1971 Kessler
3,660,059 A 5/1972 Hollemann et al.
5,380,346 A 1/1995 Feitz
5,685,170 A * 11/1997 Sorensen ..... 62/625
5,697,987 A * 12/1997 Paul ..... 44/352
5,842,623 A 12/1998 Dippold
6,607,567 B1 8/2003 Towfighi

FOREIGN PATENT DOCUMENTS

GB 0813981 5/1959

* cited by examiner

*Primary Examiner*—Thuan D Dang
(74) *Attorney, Agent, or Firm*—Sidley Austin Brown & Wood, LLP

(57) ABSTRACT

A fuel for internal combustion-powered tools, especially for setting tools for fastening elements and based on a liquefied, combustible gas or gas mixture with a vapor pressure of 2 to 15 bar absolute at 20° C., and at least one combustible compound, which is soluble in the gas or gas mixture and is a liquid at 20° C. and atmospheric pressure, and which is used as an agent for improving the combustion behavior.

3 Claims, No Drawings

FUEL FOR INTERNAL COMBUSTION-POWERED TOOLS

BACKGROUND OF THE INVENTION

1. Field of Invention

The present invention relates to a fuel for internal combustion-powered tools, especially for setting tools for fastening elements, such as gas-powered nail-driving tools, and based on a liquefied, combustible gas or gas mixture with a vapor pressure from about 2 to 15 bar absolute at 20° C.

2. Description of the Prior Art

Internal combustion-powered tools of the type described above, namely, setting tools for fastening elements, are known, for example, from German publication DE-A-40 32 202. With the help of these tools, fastening elements, such as nails, bolts, etc., can be driven directly, under the action of the power of combustion of the combusted fuel, normally a liquefied, inflammable gas or gas mixture, into materials, such as wood, steel, concrete and the like, to which a fastening element is to be fastened.

Internal combustion-powered tools of this type include, for example, a combustion chamber and a piston, which can be moved in a piston guide and is acted upon by the expanding combustion gasses produced in the combustion chamber. By igniting the mixture of air and fuel filling the combustion chamber, the piston is moved away from the combustion chamber, strikes the fastening element and drives it into the material. The energy gained by the combustion of the fuel depends to a large degree on the rate of combustion, which, in turn, depends on the fuel to air ratio.

In conventional, internal combustion-powered tools of this type, a mixture of, for example, methylacetylene and propadiene or a mixture of propane, butane, propene or ethane is used as fuel. For conventional, commercial, internal combustion-powered tools of this type, especially mixtures of methyl acetylene, propadiene, propene and/or butane are used, which are also known under the name of MAPP. Such gas mixtures are obtained as waste products when coking low-grade anthracite and provide a relatively high combustion speed, which is important if the tools are to have a high efficiency.

However, these conventional fuels have a series of disadvantages. For example, the commonly used MAPP mixtures generally contain small amounts of butadiene, which is poisonous and permissible only in amounts of less than 0.1% by weight. Pure, butadiene-free MAPP gases are difficult to obtain and expensive. Conventional mixtures of hydrocarbons or pure hydrocarbon gases, such as butane or propane, burn more slowly and are not suitable for the present application.

In particular, most of the known gas mixtures, used as fuels, evaporate slowly and weakly at low temperatures (−5° C.). This is a problem for the tools in question, which must also be usable on building sites even at temperatures below 0° C.

On the other hand, hydrocarbons, which evaporate quickly and almost completely at low temperatures, are obtainable only at great expense and frequently have excessively high vapor pressures, which make it difficult to adhere to government regulations concerning the handling of liquid gas mixtures of this type. For example, the aerosol regulations require that the pressure of the liquefied gas mixture at 50° C. does not exceed 12 bar above atmospheric pressure.

If one attempts to solve the problems of conventional fuels at low temperatures by adding a larger amount of fuel to the combustion chamber and, with that, using a fatter mixture, problems arise at high temperatures (for example, at 50° C.) in the combustion space, so that it is more difficult to control the combustion energy, which is to be used, and, with that, the driving-in energy of the fastening element.

An object of the present invention is to provide a fuel for internal combustion-powered tools of the type under discussion, which not only is composed of components, which are safe form a health point of view, but also can be produced inexpensively.

Another object of the present invention is to provide a fuel for internal combustion tools and having an improved cold temperature behavior and, if necessary, an improved warm temperature behavior.

SUMMARY OF THE INVENTION

These and other objects of the present invention, which will become apparent hereinafter, are achieved with a fuel for internal combustion-powered tools, especially for setting tools for fastening elements, on the basis of a liquefied, combustible gas or gas mixture with a vapor pressure of 2 to 15 bar absolute at 20° C., wherein the gas or gas mixture contains at least one combustible compound, which is a liquid at 20° C. and atmospheric pressure and is soluble in the gas or gas mixture, as an agent for improving the combustion behavior.

Due to the inventive addition of a combustible compound, which is a liquid at 20° C. and at atmospheric pressure (101.325 Pa) and soluble in the liquefied, combustible gas or gas mixture, a distinct improvement is attained in the cold temperature behavior. For example, in the first phase of the combustion, heat is evolved, and the temperature increases with the burning of the low boiling components of the liquefied, combustible gasses. By this means, the vapor pressure of the combustible compound, which is added pursuant to the invention, is increased so that the compound is evaporated and participates in a second phase of the combustion. This results in an increase in the speed of the flame front in the combustion chamber, an increase in the conversion of fuel during the combustion reaction, and an advantageous improvement in the turbulence of the combustion flame.

At high air temperatures in the combustion chamber of, for example, 60° to 80° C., the combustible compound, added pursuant to the invention, largely participates in the combustion from the start and as a high-boiling component. This result in improvement in the warm temperature behavior. To prevent the mixture from becoming too fat, solvents are used, which are preferred pursuant to the invention and which contain at least one oxygen atom, so that the amount of air, required by these compounds, is reduced.

Accordingly, the total pressure of the fuel is lowered by bringing the inventive, combustible compound into the liquefied, combustible gas or gas mixture. This effect enables to meet the aerosol regulations with regard to the maximum pressure of 12 bar overpressure at 50° C. to without any problems.

This combustible compound, which is a liquid at 20° C. and at atmospheric pressure, may be inorganic or organic. In accordance with a preferred embodiment, a liquid, combustible, organic compound is used, which preferably has a boiling point at atmospheric pressure of 20° to 140° C. and preferably of 50° to 90° C. In particular, an organic solvent, especially an oxygen-containing organic solvent, is preferred for this purpose. Methanol, ethanol, acetone, methyl acetate or mixtures of the solvents are organic solvents, which are particularly preferred pursuant to the invention.

Preferably, the inventive fuel contains the liquid, combustible, organic compound in an amount of 3% to 30% by weight and especially of 5% to 20% by weight.

Pursuant to the invention, propane, propene, propadiene, n-butane, isobutane, butene, dimethyl ether, methylacetylene, nitrous oxide, nitromethane and their mixtures are used as liquefied, combustible gases or gas mixtures. Liquefied natural gas, mixtures of methylacetylene and propadiene and/or mixtures of dimethyl ether, propene and isobutane are preferred gas mixtures of this type.

DETAILED DESCRIPTION OF THE PREFERRED EMBODIMENT

In accordance with a particularly preferred embodiment of the invention, a mixture of 20 to 80% by weight, preferably of 1 to 10% by weight and particularly of 35% by weight of dimethyl ether, of 1 to 15% by weight, preferably of 30 to 40% by weight and particularly of 5% by weight of propane and 5 to 79% by weight, preferably of 25 to 69% by weight and particularly of 60% by weight of isobutane is used as a combustible gas mixture.

The inventive fuel is contained, preferably in compressed or liquefied form, in a pressurized container with a delivery valve, especially in a two-chamber aerosol can. In accordance with a particularly preferred embodiment of the invention, this fuel is in the inner chamber or the inner bag of a two-chamber aerosol can, from which it can be supplied by means of a compressed gas, which is present in the outer chamber, to the combustion space of the internal combustion-powered tool.

Below an example of an inventive fuel for a setting tool is given.

EXAMPLE

A mixture of 35% by weight of dimethyl ether, 5% by weight of propene and 60% by weight of isobutane, as well as a corresponding mixture, which contains 10% by weight of methanol is used. The evaporation rate of both mixtures is measured at −5° C. For this purpose, equal amounts of the respective mixtures are sprayed into the same combustion chamber and the increase in pressure is measured as a function of time. After 200 ms, an increase in pressure of 40 mbar is obtained with the inventive fuel and of only 30 mbar with the same fuel without methanol. On the other and, after a correspondingly long waiting time of three seconds, a pressure increase of 100 mbar is obtained with both gas mixtures.

It may be noted that the inventive fuel surprisingly causes a much more rapid evaporation at low temperatures and, with that, a satisfactory operation of the internal combustion-powered tool, which is supplied with the inventive fuel, even at low temperatures.

Though the present invention was shown and described with references to the preferred embodiment, such is merely illustrative of the present invention and are not to be construed as a limitation thereof, and various modifications of the present invention will be apparent to those skilled in the art. It is, therefore, not intended that the present invention be limited to the disclosed embodiment or details thereof, and the present invention includes all variations and/or alternative embodiments within the spirit and scope of the present invention as defined by the appended claims.

What is claimed is:

1. A fuel for internal combustion-powered tools, comprising one of liquefied, combustible gas or gas mixture with a vapor pressure of 2 to 15 bar absolute at 20° C.; and an agent for improving combustion behavior of the fuel and containing at least one combustible compound soluble in the one of gas or gas mixture and is a liquid at 20° C. and atmospheric pressure; wherein the one of liquefied, combustible gas and gas mixture comprises propane, propene, propadiene, n-butane, isobutane, butene, dimethyl ether, methylacetylene, nitrous oxide, nitromethane, and their mixtures and wherein the one of combustible gas mixture and gas is a combustible gas mixture comprising a mixture of 20 to 80% by weight of dimethyl ether, 1 to 15% by weight of propene and 5 to 79% by weight of isobutane.

2. The fuel of claim 1, wherein the combustible gas mixture comprises a mixture of 30 to 40% of dimethyl ether, 1 to 10% of propene and 25 to 69% of isobutane.

3. The fuel of claim 1, wherein the combustible gas mixture comprises a mixture of 35% by weight of dimethyl ether, 5% by weight of propene and 60% by weight of isobutane.

* * * * *